US011610566B2

(12) United States Patent
Müller et al.

(10) Patent No.: US 11,610,566 B2
(45) Date of Patent: Mar. 21, 2023

(54) HARMONICA

(71) Applicant: HOHNER Musikinstrumente GmbH, Trossingen (DE)

(72) Inventors: Gerhard Müller, Trossingen (DE); Ines Weber, Tuttlingen (DE)

(73) Assignee: HOHNER Musikinstrumente GmbH, Trossingen (DE)

( * ) Notice: Subject to any disclaimer, the term of this patent is extended or adjusted under 35 U.S.C. 154(b) by 0 days.

(21) Appl. No.: 17/592,338

(22) Filed: Feb. 3, 2022

(65) Prior Publication Data

US 2022/0270573 A1 Aug. 25, 2022

(30) Foreign Application Priority Data

Feb. 19, 2021 (DE) ..... 10 2021 000 882.0

(51) Int. Cl.
*G10D 7/14* (2020.01)

(52) U.S. Cl.
CPC ..... *G10D 7/14* (2020.02)

(58) Field of Classification Search
CPC ..... G10D 7/14
See application file for complete search history.

(56) References Cited

U.S. PATENT DOCUMENTS

| | | | | | |
|---|---|---|---|---|---|
| 2,511,302 | A * | 6/1950 | Stephenson | G10D 7/14 | 984/137 |
| 4,237,766 | A * | 12/1980 | Marshall | G10D 7/14 | 984/137 |
| 5,166,461 | A * | 11/1992 | Salwitz | G10D 7/14 | 84/377 |
| 8,153,875 | B1 * | 4/2012 | Beauregard | G10D 7/14 | 84/330 |
| 8,431,807 | B1 * | 4/2013 | Beauregard, IV | G10D 9/00 | 84/377 |
| 2022/0270573 | A1 * | 8/2022 | Müller | G10D 7/14 | |

FOREIGN PATENT DOCUMENTS

| | | |
|---|---|---|
| DE | 202007014926 U1 | 2/2008 |
| DE | 202009012020 U1 | 12/2009 |

* cited by examiner

*Primary Examiner* — Robert W Horn
(74) *Attorney, Agent, or Firm* — Kilpatrick Townsend & Stockton LLP

(57) ABSTRACT

Harmonica with a blues scale based on the minor pentatonic scale, which is formed from the pentatonic scale in the minor key by adding the diminished fifth, comprising at least 10 combs, which are tuned to an arrangement of notes of the blues scale with a multi-octave range, and the comb assignment of the blow and draw channels is determined by a sound arrangement of the scale-specific notes of the minor blues scale, for which purpose the three adjacent combs of at least one octave are tuned to the blow notes (1), (4), (5) and to the draw notes ($3^b$), ($5^b$), ($7^b$).

7 Claims, 2 Drawing Sheets

1 - prime
$3^b$ - minor third
4 - fourth
$4^\#$ / $5^b$ - augmented fourth/diminished fifth
5 - fifth
$7^b$ - minor seventh
8 - octave

| | |
|---|---|
| 1 | - prime |
| $3^b$ | - minor third |
| 4 | - fourth |
| $4^\#$ / $5^b$ | - augmented fourth/diminished fifth |
| 5 | - fifth |
| $7^b$ | - minor seventh |
| 8 | - octave |

Fig. 2

| | | | | | | | | | | |
|---|---|---|---|---|---|---|---|---|---|---|
| Blow | 1 | 4 | 5 | 1‘ | 4‘ | 5‘ | 1“ | 4“ | 5“ | 1“‘ |
| Channel | 1 | 2 | 3 | 4 | 5 | 6 | 7 | 8 | 9 | 10 |
| Draw | $3^b$ | $5^b$ | $7^b$ | $3^{b‘}$ | $5^{b‘}$ | $7^{b‘}$ | $3^{b“}$ | $5^{b“}$ | $7^{b“}$ | $3^{b“‘}$ |

Fig. 3

| | | | | | | | | | | |
|---|---|---|---|---|---|---|---|---|---|---|
| Blow | c | f | g | c‘ | f‘ | g‘ | c“ | f“ | g“ | c“‘ |
| Channel | 1 | 2 | 3 | 4 | 5 | 6 | 7 | 8 | 9 | 10 |
| Draw | $e^b$ | $g^b$ | $b^b$ | $e^{b‘}$ | $g^{b‘}$ | $b^{b‘}$ | $e^{b“}$ | $g^{b“}$ | $b^{b“}$ | $e^{b“‘}$ |

HARMONICA

CROSS-REFERENCE TO RELATED APPLICATIONS

This application is a non-provisional of and claims the benefit of and priority to German Patent Application No. DE 10 2021 000 882.0, filed Feb. 19, 2021, and entitled "HARMONICA," the entire contents of which is incorporated herein by reference for all purposes.

FIELD OF THE INVENTION

The invention relates to a harmonica with pentatonic tuning. This harmonica excels at playing a blues scale, which is simply accessed by performing a sequence of blow and draw notes up and down the harmonica.

BACKGROUND OF THE INVENTION

A harmonica is a musical instrument with a certain tuning. The known harmonicas' note layout are a compromise, which in particular considerably limits the minor tonality, as is known for example from DE 20 2009 012 020 U1.

The standard harmonica tuning is known as the Richter harmonica. The Richter harmonica is a diatonic harmonica with "Richter tuning", which has ten combs or blow holes. The tone arrangement of the Richter tuning is based on a major scale that has omissions and duplications of the notes in the lower octave.

The range of notes of the Richter harmonica is well-suited for simple songs and there are playing techniques with which all of the missing semitones of the chromatic scale can be reached, known as bending, overblowing and overdrawing. By arranging a blow note and a draw note per comb, the pitch can be altered, to differ from its actual tuning, by adjusting the mouth cavity while playing. Thus, when breathing/drawing through the comb, the blow reed plate can also be set in motion (overdrawing). This results in a pitch change of, for example, at least one semitone. In particular by bending, more notes can consequently be made available than are provided by the Richter tuning.

Bending is a particularly common playing technique among blues musicians, as it allows not only chromatic playing with the available notes, but also a smooth tone-to-tone transition and playing with blue notes and other special leading tones as is common in the blues. The playing techniques of bending and overblowing need to be learned and these playing techniques also have certain limits, which is disadvantageous.

It is also known from DE 20 2007 014 926 U1 to provide a changed tone arrangement in comparison with Richter tuning while retaining the simple construction of the diatonic harmonica with 10 combs. Consequently, what is changed is the construction of the reed plates, while the scale of notes remains unchanged. Here, too, playing with blue notes is only possible by means of bending.

The object of the present invention is therefore to provide a harmonica which improves playing the pitches of blue notes.

SUMMARY

This object is achieved by the features of claim 1.

This provides a harmonica that uses the notes of the minor blues scale, these being arranged in such a way that they occupy the blow notes and draw notes of the instrument in a scale-appropriate sequence and alternating between top and bottom. Unlike Richter tuning, there are no omissions and doubling of notes, but the notes of an octave are alternately assigned to the blow and draw channels of the comb. The blue notes can thus be played directly, without the need for bending.

Furthermore, unlike the diatonic Richter harmonica which follows a chord concept, the harmonica according to the invention is preferably played one note at a time, and for this purpose has a scale-specific tonal range concept of a multi-octave configuration. According to the invention, the pitch changes of the minor blues scale are preferably generated as a core octave running up and down on three combs/channels. Adjacent octaves can have the same or a different structure.

Further advantages and embodiments of the invention are shown in the following description and subclaims.

The invention is explained in more detail below on the basis of the exemplary embodiments shown in the appended figures.

BRIEF DESCRIPTION OF THE DRAWINGS

FIG. 2 is a diagram of the exemplary assignment of combs 1-10 of a harmonica according to the invention, FIG. 3 is a schematic representation of the exemplary assignment of combs 1-10 of the harmonica according to the invention in c minor of the pentatonic minor blues scale.

DETAILED DESCRIPTION

Figure 1:
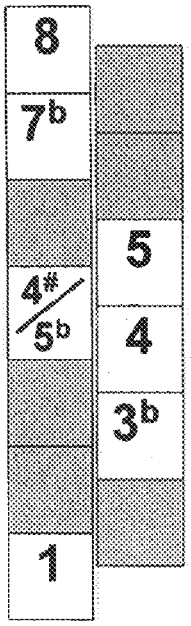
FIG. 1 is a diagram of the minor blues scale, the notes of the scale being numbered for easy representation.

The invention relates to a pentatonic tuned harmonica. In this respect, FIG. 1 shows a pentatonic minor blues scale. The lowest box shows the tonic. The boxes above are the notes of the scale, named according to their interval from the tonic. Thus, the scale is to be read in the form of a zigzag. The upper box shows the same note as the tonic, just an octave higher. The notes of the scale are numbered for better representation. The designations of the intervals or degrees of the scale associated with the numbering are given as a legend.

The harmonica with a blues scale based on the minor pentatonic scale is formed from the pentatonic scale in the minor key by adding the diminished fifth and comprises at least 10 combs (blow holes), preferably 10 combs. According to the invention, the at least 10 combs are tuned to an arrangement of notes of the blues scale with a multi-octave range. The comb assignment of the blow and draw channels is thereby determined by a tone arrangement of the scale-specific notes of the minor blues scale. The three adjacent combs of at least one octave are tuned to the blow notes (1), (4), (5) and to the draw notes ($3^b$), ($5^b$), ($7^b$) in an ascending and descending manner.

In the harmonica according to the invention, adjacent octaves may preferably have the same structure, for example be higher octaves.

In the harmonica according to the invention, adjacent octaves may alternatively have a different structure, for example be octaves of different keys.

The harmonica according to the invention preferably has a range comprising three octaves. The exemplary embodiment shown in FIG. 2 shows the harmonica described above with three octaves of the minor blues scale, with, for example, 10 combs. In addition to the three octaves, it may be provided according to the invention that, in addition to three octaves, the first notes of a fourth octave can be played.

Consequently, 10 combs are then provided, covering sounds over three octaves and the first notes of a fourth octave.

FIG. 3 shows an exemplary embodiment of the harmonica according to the invention which comprises three adjacent combs of at least one octave which are tuned to the blow notes c (1), f (4), g (5) and to the draw notes $e^b$ ($3^b$) $g^b$ ($5^b$) $b^b$($7^b$) in c minor. Preferably, two higher octaves of the same key are provided for the tuning of the combs. The combs may in the same way be tuned to other keys of the pentatonic minor blues scale.

Harmonicas with more than 10 combs, for example 12 combs, may also be provided. Preferably, four octaves can then be played completely.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

We claim:

1. Harmonica with a blues scale based on the minor pentatonic scale, which is formed from the pentatonic scale in the minor key by adding the diminished fifth, comprising at least 10 combs, which are tuned to an arrangement of notes of the blues scale with a multi-octave range, and the comb assignment of the blow and draw channels is determined by a sound arrangement of the scale-specific notes of the minor blues scale, for which purpose the three adjacent combs of at least one octave are tuned to the blow notes (1), (4), (5) and to the draw notes ($3^b$) ($5^b$) ($7^b$).

2. Harmonica according to claim 1, characterized in that adjacent octaves have the same structure.

3. Harmonica according to claim 1, characterized in that adjacent octaves have different structures.

4. Harmonica according to claim 1, characterized in that the range comprises three octaves.

5. Harmonica according to claim 1, characterized in that the three adjacent combs of at least one octave are tuned to the blow notes c (1), f (4), g (5) and to the draw notes $e^b$ ($3^b$), $g^b$ ($5^b$), $b^b$ ($7^b$) in c minor.

6. Harmonica according to claim 1, characterized in that 10 combs are provided, covering sounds over three octaves and the first notes of a fourth octave.

7. Harmonica according to claim 1, characterized in that 12 combs are provided, covering sounds over four octaves.

* * * * *